United States Patent [19]

Reinhall

[11] 4,401,280

[45] Aug. 30, 1983

[54] DISC-TYPE PULP REFINING APPARATUS

[75] Inventor: Ulf Reinhall, Bellevue, Wash.

[73] Assignee: Sunds Defibrator, Inc., Minneapolis, Minn.

[21] Appl. No.: 184,747

[22] Filed: Sep. 8, 1980

[51] Int. Cl.[3] ..... B02C 23/02

[52] U.S. Cl. ..... 241/247; 241/261.1

[58] Field of Search ..... 241/244, 245, 247, 260, 241/261, 261.1; 162/23, 28, 261; 51/431, 434

[56] References Cited

U.S. PATENT DOCUMENTS

| | | | |
|---|---|---|---|
| 2,108,211 | 2/1938 | Rosenberger et al. | 51/434 |
| 3,977,128 | 8/1976 | Goff | 51/431 X |
| 4,081,146 | 3/1978 | Yagi | 241/247 X |
| 4,082,233 | 4/1978 | Reinhall | 241/247 X |
| 4,090,672 | 5/1978 | Ahrel | 241/261.1 |
| 4,126,280 | 11/1978 | Burk | 51/434 X |
| 4,166,585 | 9/1979 | Alford et al. | 51/434 X |
| 4,220,290 | 9/1980 | Johansson | 241/247 |
| 4,221,631 | 9/1980 | Hellerquist | 162/28 X |

FOREIGN PATENT DOCUMENTS

| | | | |
|---|---|---|---|
| 2905419 | 8/1979 | Fed. Rep. of Germany | 241/244 |
| 834793 | 12/1938 | France | 241/247 |

*Primary Examiner*—James L. Jones, Jr.
*Assistant Examiner*—Robert P. Olszewski
*Attorney, Agent, or Firm*—Eric Y. Munson

[57] ABSTRACT

Apparatus for refining pulp stock which is ground in an inclined grinding zone extending from a peripherally outer portion of a pair of opposed disc members which rotate relative to one another within a housing. The pulp stock is advanced by a conveyor into a central opening between the opposed disc members, from which opening it is accelerated radially towards the grinding zone under the influence of the centrifugal force generated by the rotational movement of the disc members by means of a plurality of sector-shaped channels defined between the opposed disc members.

8 Claims, 3 Drawing Figures

10
12
14
16
18
20
22
24
26
28
30
32
34
36
38
40
42
44
46
48
50
52
54
56
58
60
62
α
II

DISC-TYPE PULP REFINING APPARATUS

BACKGROUND OF THE INVENTION

The present invention relates to grinding apparatus of the disc type for grinding pulp material, preferably lignocellulose-containing material in the form of chips. The grinding members rotate relative to one another and are provided with grinding surfaces located at a distance from the center of rotation. Said grinding surfaces define therebetween a grinding space for the material to be ground. The grinding space preferably extends at an angle to the axis of rotation. An especially important field of application of the invention are defibrating machines or refiners for manufacture of fibre or paper pulp from wood chips or other similar cellulose-containing material.

Grinding apparatus of the disc type have hitherto been formed with a grinding space between the grinding members with main extension in radial direction, said space extending from a central feed-out zone for the starting material where the centrifugal force is relatively low. The centrifugal force acting on the material or pulp stock is then increased very strongly with increasing radial spacing from the centre of rotation. In order to prolongate the period of stay of the material in the outer portion of the grinding space zone it has been proposed in the co-pending U.S. patent application Ser. No. 877,809, filed Feb. 17, 1978, now U.S. Pat. No. 4,253,613, to design the grinding space in the outer grinding zone with extension in axial direction so as to permit a fraction only of the total centrifugal force to actuate the pulp stock in the direction of flow determined by the outer space portion. Whereas measures have been taken in the radially outer portion of the grinding space to restrict the speed of flow of the pulp stock towards the peripherally outer outlet side of the grinding zone. These measures are still hampered by the phenomenon that the actuation by the centrifugal force in the central feed-out zone is low so that the supply to the outer grinding zone is not so intensive as desirable for operation of the grinding apparatus with its highest capacity. Therefore, application of mechanical devices for promoting said feeding advance have been tried in the central zone of the apparatus, but these devices have proved to be not so effective as presumed i.a. because they require to be replaced relatively often since they are subjected to rapid wear.

SUMMARY OF THE INVENTION

It is thus one main object of the invention to eliminate this drawback and to advance the material to be ground into the inclined grinding zone which guarantees that this zone constantly is given sufficient supply of material for full utilization of its grinding capacity. This is obtained substantially by providing one of the rotatable grinding members with discharge channels extending annularly from a central inlet and opening into the grinding space and within which channels the material to be ground is conveyed out to the grinding space by the centrifugal force.

In these channels the material to be ground is acted upon the centrifugal force with maximum intensity due to the fact that strands or columns of material fill up the channels and are forced towards the outer grinding space at the inlet thereof. Since the partition walls of the channels are located entirely in a rotating element, no retardation will be produced in a similar manner as in an inner conventional grinding space where the pulp stock has to pass between grinding surfaces formed with ridges and grooves which rotate relative to one another.

BRIEF DESCRIPTION OF THE DRAWINGS

The invention will be described hereinafter with reference to a preferred embodiment shown by way of example in the accompanying drawing which forms part of this specification and of which.

DETAILED DESCRIPTION OF EMBODIMENT OF THE INVENTION

Figures 1, 2:
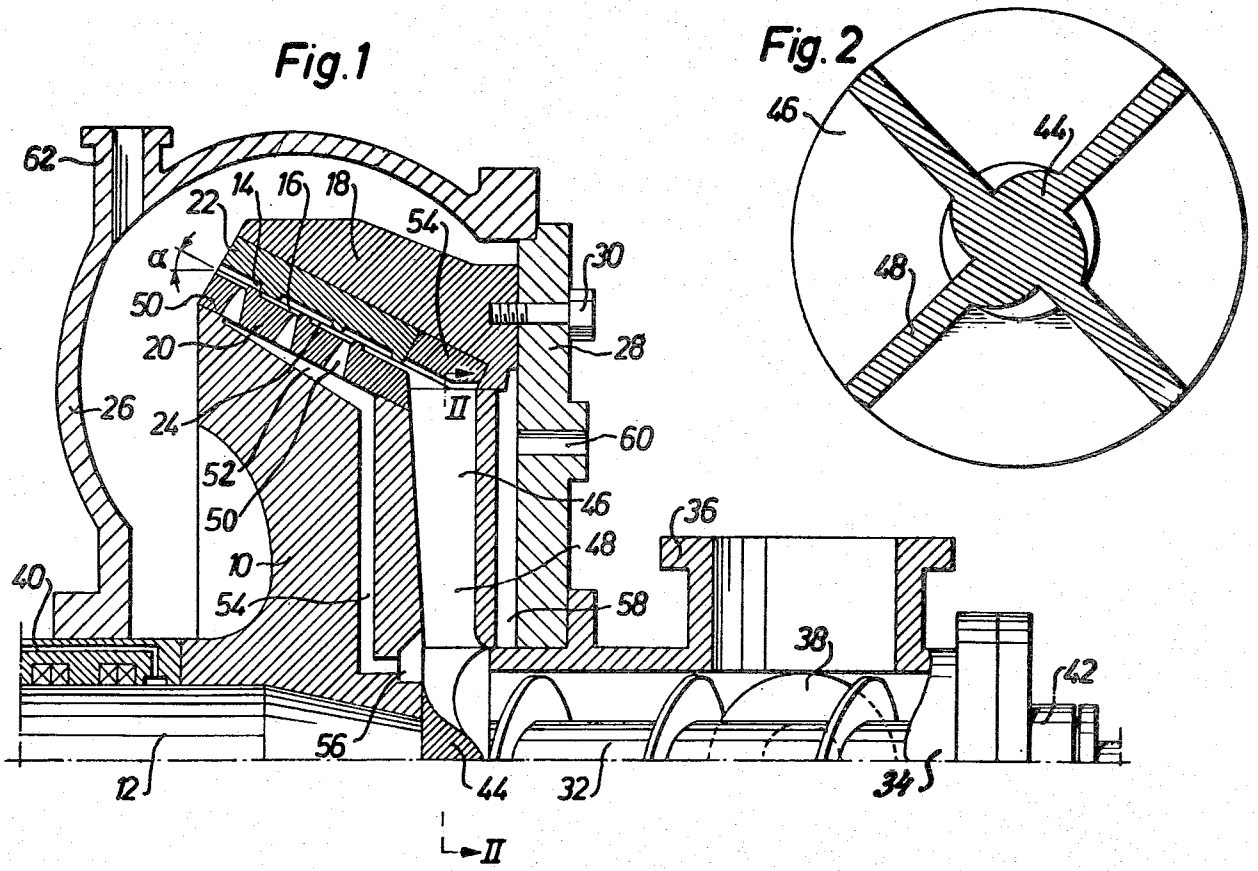
FIG. 1 is a vertical longitudinal section of the upper part of a grinding apparatus or refiner embodying the features of the invention.
FIG. 2 is a section following line II—II of FIG. 1.

Referring now to the drawing and in particular FIG. 1, reference numeral 10 denotes a rotatable grinding disc or rotor which is rigidly secured onto a rotatable shaft 12. The rotor 10 is on its outer portion provided with a grinding surface 16 having extension in axial direction This grinding surface cooperates with a stationary grinding surface 14 located on a stator ring 18. The grinding surfaces are in known manner equipped with grooves and ridges and are preferably subdivided into segments 20 and 22, carried by the rotor 10 and the stator ring 18, respectively. The preferably conically shaped grinding surfaces define a grinding space 24 for the pulp stock which extends at an angle of inclination $\alpha$ to the shaft of the rotor which is less than 45°, preferably less than 30° and most suitably ranges between 15° and 8°. The elements 10, 18 forming the grinding space are encased in a pressure-proof casing which is composed of a two-piece case 26 and an end plate 28 which closes said case laterally and onto which the stator ring is rigidly secured by screws 30.

The shaft 12 is axially displaceable for adjustment of the space 24 and for generation of required grinding pressure between the grinding surfaces. This can be accomplished by means of a hydraulic servo motor mechanism (not shown here), as is described e.g. in the U.S. Pat. No. 3,212,721.

The material to be ground such as wood chips, is fed centrally to the grinding disc 10 by a conveyor screw 32 which is disposed coaxially with the shaft 12 within a tubular housing 34 rigidly connected with the casing 26, 28. Said tubular housing has a vertical inlet opening 36 and a horizontal inlet opening 38 for the material to be ground. Both inlet openings are in pressure-proof manner sealed from the outer atmosphere in conventional manner by means of gas-tight feed-in devices e.g. in the shape of a compressing screw or rotating valves with or without interposed detaining vessels (not shown here) for preparation of the material to be ground under increased pressure and/or at elevated temperature. The casing 26, 28 is in pressure-proof manner sealed against the shaft 12 by means of a stuffing box 40, and similarly a stuffing box 42 is interposed between the tubular case 34 and the driving shaft of the screw 32.

The conveyor or feed screw 32 advances the material to be ground towards the centre of the rotating grinding member 10 where it is brought to move in radial direction by a centrally positioned, vane-equipped deflector rotor 44. The material to be ground is thereupon introduced into a number of discharge channels 46 disposed symmetrically about the circumference within the grinding member proper and thus entirely encased by said grinding member. The channels are separated from one another by partition walls 48 which throw the material to be ground directly towards the inclined grinding zone 24. The partition walls 48 extend radially outwards from the centre of the grinding member to the grinding zone 24. They may be straight and equally broad, in which case the cross-section of the channels increases in width in radially outward direction which in turn results in maximum effect exerted by the centrifugal force on the material to be ground. However, the channel walls may also be bent backwards similarly to pump blades. The channels 46 have an extension in radial direction which is many times greater than the width of the grinding space 24. Therefore, the channels are capable of housing a volume of material to be ground which by far exceeds the volume that the space 24 can hold.

The material supplied to the radial discharge channels 46 is partly accumulated within the same and forms radial columns rotating with the grinding member 10, which columns thus with their entire accumulated weight and under rotation are accelerated by the centrifugal force towards the primary zone of the stationary grinding surface 14.

Hereunder the material to be ground is disintegrated primarily, while at the same time a minor vector of the centrifugal force in direct proportion to the angle of inclination of the grinding space acts on the material under movement towards the greater diameter of the grinding zone, while the material is treated further between the segments 20 of the rotating grinding material 10 and the segments 22 of the statory grinding member or stator ring 18. The spacing of these segments from one another is adjusted to a predetermined operative value by axial displacement of the shaft 12 carrying the rotatable grinding member 10.

A grinding apparatus of the type described hereinbefore has very high efficiency and the energy supplied through the shaft 12 thus reaches a very high value. A great portion of this energy is transformed into heat so that steam under pressure is generated in the grinding space 24. In accordance with the disclosure in U.S. patent application Ser. No. 6,184,756 filed simultaneously with this application the major portion of this steam is separated off from the pulp stock under treatment in the grinding zone through channels 50 which extend radially inwards from the rotating grinding surface to a collecting channel 52. A plurality of such channels 50 may be distributed both peripherally about the circumference of the grinding surface and in the direction of flow of the pulp stock. In the embodiment shown in this application the separated steam is conducted through channels 54 in the grinding disc 10 radially inwards where the channels 54 open into a room 56 behind the deflecting member 44 and from there into the radial channels 46.

The major part of the steam which is generated in the grinding treatment and from which by the action of the centrifugal force substantially all pulp stock has been removed is through this channel system returned to the intake side of the apparatus where it can be utilized for preheating of the material to be ground. Pulp stock nevertheless entrained with the steam and possibly not completely treated can in this way be returned to the grinding space 24 for final disintegration.

Formed between the stationary end plate 28 and the central portion of the grinding disc 10 is a space 58 which is sufficiently great in axial direction to permit axial readjustment of the grinding disc 10 to compensate for gradual wear of the grinding surfaces. To this space liquid such as water can be supplied under pressure through a pipe 60 in order both to prevent pulp stock from penetrating into the space and to supply liquid to the material to be ground.

The finally treated pulp is sluiced out from the casing of the grinding apparatus through an outlet 62.

Obviously, the invention is not limited to the shown and described embodiment, but may be varied in many respects within the scope of the basic idea thereof. Thus, the steam generated in the grinding space may be withdrawn therefrom through channels in some other way e.g. as described in the above-cited patent application filed simultaneously with this application.

The channels or pockets 46 need not be enclosed at both lateral walls by the grinding member 10 but may be open towards the member 28. The blades or wings 48 will then closely cooperate with a smooth surface on the adjacent, such as stationary member 28 so that the channels or pockets 46 become laterally separated from one another. The function of the blades 48 will also in such case serve just to transport the grinding material outwardly to the grinding space 24, that is they have practically no grinding effect on the material.

Between the pockets 46 and grinding space 24 a short zone may be provided forming a radially extending preliminary grinding space for the grinding material.

As will be apparent from the aforesaid the axial width of the pockets 46 is many times greater than the width of the grooves between the ridges of the grinding space 24.

Figure 3:
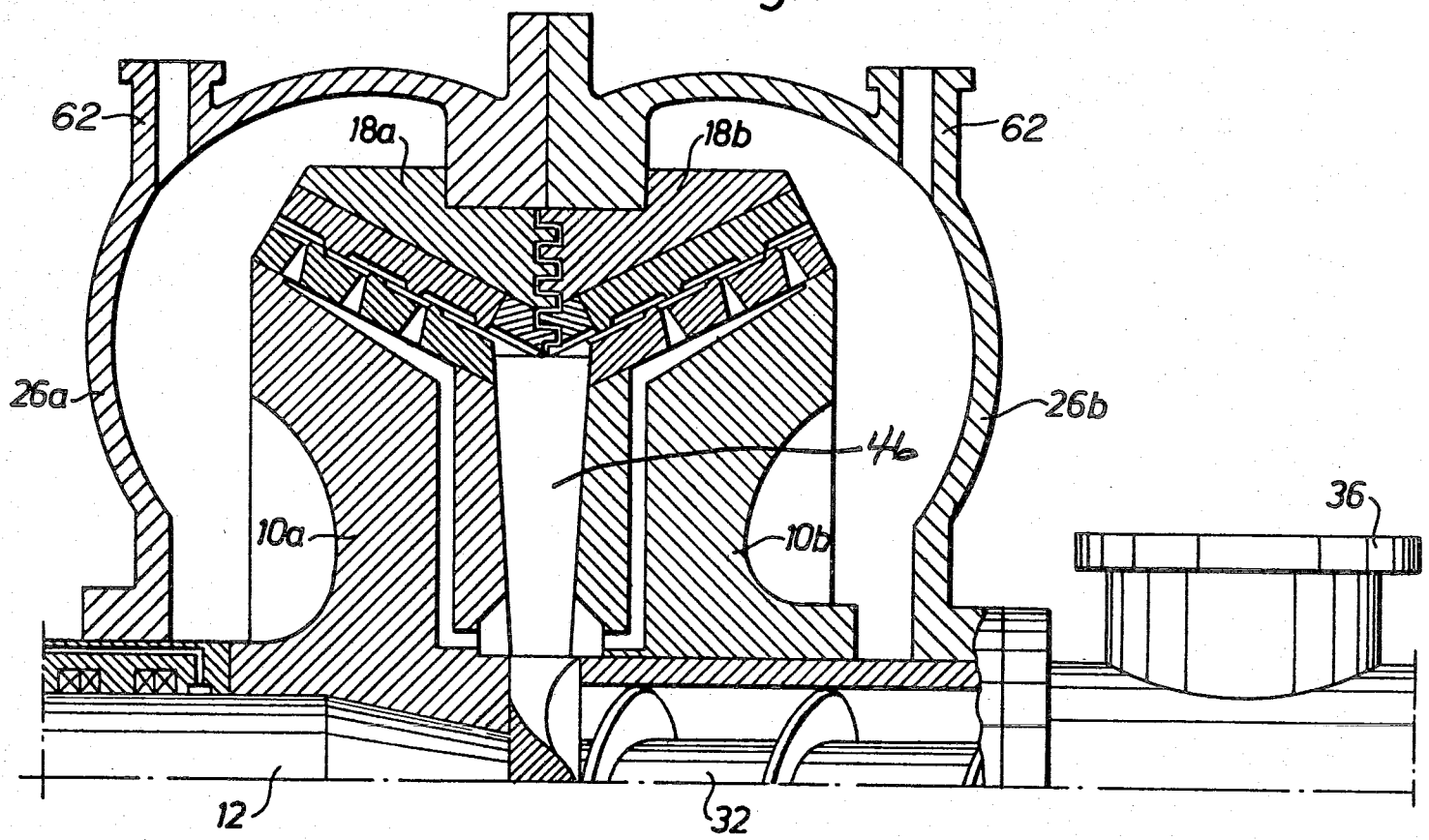
FIG. 3 is a sectional view similar to FIG. 1 of a modification of the invention.

The invention is, thus, also applicable to a grinding apparatus as shown in FIG. 3 in which there are two grinding spaces which extend from a radial discharge space for the material to be ground in two opposite essentially axial directions from the radial discharge space in the shape of an Y or V. The common radial discharge space will then be connected to the inlet portion of each axial grinding space which are conically shaped having an angle of inclination to the shaft of the rotor as hereinbefore defined. The Y- or V-shaped embodiment is essentially an apparatus in which the right casing wall 28 of the apparatus in FIG. 1 is replaced by a reflected image **10*b* of the grinding disc 10*a* and stator ring 18*b* forming a grinding space connected to the channels 46. In order to make possible the adjustment of the two stator rings 18*a* and 18*b* relative to the grinding disc and to each other in such doubled embodiment their abutting edges may have the shape of a labrinth seal with fingers on each stator ring extending into each other. The rotation of the grinding discs 10*a* and 10*b*** in such embodiment may be in the same or in opposite directions.

The ground pulp material is discharged from the casings **26*a* and 26*b* through discharge pipes 62*a* and 62*b***, respectively.

I claim:

1. In an apparatus for refining lignocellulosic pulp stock, such as wood chips, sawdust, bagasse and the like, in which the pulp stock is ground in a grinding zone extending axially at an angle to the axis of rotation of a pair of opposed disc members, which rotate relative to one another within a housing in the environment of a fluid medium, said grinding zone being defined between a rotating grinding element carried by an outer peripheral portion of at least one of said opposed disc members, said grinding zone extending at an angle from an inner portion of at least one of said opposed disc members, said inner portion extending radially outwards from the axis of rotation, and a facing correspondingly inclined stationary grinding element mounted in said housing, the pulp stock being advanced by conveyor means into a central opening in said inner portion and discharged from said housing by valve means after completion of the grinding operation, the improvement comprising:

a plurality of sector-shaped channels in said inner portion for receiving the pulp stock from said central opening and accelerating it toward said grinding zone under the influence of the centrifugal force generated by the relative rotational movement of said opposed disc members, the axial width of said sector-shaped channels being defined by two spaced annular wall members in said inner portion and the sector area of said channels being defined by a plurality of rotatable blades disposed between said walls.

2. Apparatus according to claim 1, in which said grinding elements are provided with grooves and ridges and said blades are wider axially than said ridges.

3. Apparatus according to claims 1 or 2, in which said blades have substantially the same axial width as the spacing between said wall members.

4. Apparatus according to claims 1 or 2, in which both of said wall members are located in one of the rotatable disc members.

5. Apparatus according to claims 2, in which one of said wall members is a stationary member frictionally engaging the opposing edges of said rotating blades.

6. Apparatus according to claim 2, in which the grinding element carried by said at least one of said rotating disc members is provided with channels for evacuating vaporized fluid medium from said grinding zone, said at least one of said rotatable disc members being provided with duct means for conveying said evacuated vaporized medium into said sector-shaped channels.

7. Apparatus according to claim 1, in which both of said relatively rotating opposed disc members comprise outer peripheral portions diverging from one another at an angle to their axis of rotation, the rotating grinding element of each of said peripheral portions facing a corresponding inclined stationary grinding element in said housing.

8. Apparatus according to claim 7, in which the grinding elements on said rotating disc members are provided with channels for evacuating vaporized fluid medium from said diverging grinding zones, and duct means are provided in said rotating disc members for conveying the evacuated vaporized medium into said sector-shaped channels.

* * * * *